US006565412B1

(12) United States Patent
Thrasher

(10) Patent No.: US 6,565,412 B1
(45) Date of Patent: May 20, 2003

(54) HOOD AND TRUNK LID LIFTING MECHANISM FOR MODEL CAR

(75) Inventor: Matthew S. Thrasher, Toledo, OH (US)

(73) Assignee: Craft House Corporation, Toledo, OH (US)

( * ) Notice: Subject to any disclaimer, the term of this patent is extended or adjusted under 35 U.S.C. 154(b) by 351 days.

(21) Appl. No.: 09/691,393

(22) Filed: Oct. 18, 2000

(51) Int. Cl.[7] ..... A63H 17/20
(52) U.S. Cl. ..... 446/465; 446/446; 446/437
(58) Field of Search ..... 446/465, 466, 446/470, 437, 455, 424, 432, 435

(56) References Cited

U.S. PATENT DOCUMENTS

| | | | | |
|---|---|---|---|---|
| 4,125,261 A | | 11/1978 | Lahr | |
| 4,160,494 A | * | 7/1979 | McCambridge | 188/270 |
| 4,218,846 A | | 8/1980 | Lahr | |
| 4,696,655 A | | 9/1987 | D'Andrade | |
| 5,527,059 A | | 6/1996 | Lee, Jr. | |
| 5,618,219 A | * | 4/1997 | Rodmaker | |
| 5,643,041 A | | 7/1997 | Mukaida | |
| 5,722,872 A | | 3/1998 | Simmons et al. | |
| 5,762,533 A | | 6/1998 | Tilbor et al. | |
| 5,879,221 A | * | 3/1999 | Aldred | |
| 6,015,330 A | | 1/2000 | Simmons et al. | |
| 6,036,575 A | * | 3/2000 | Rehkemper et al. | 446/466 |
| 6,227,934 B1 | * | 5/2001 | Dowd | |

FOREIGN PATENT DOCUMENTS

| | | | |
|---|---|---|---|
| CA | 956793 | * | 10/1974 |
| DE | 4425128 | * | 1/1996 |

* cited by examiner

*Primary Examiner*—Derris H. Banks
*Assistant Examiner*—Jamila Williams
(74) *Attorney, Agent, or Firm*—Donald R. Fraser

(57) ABSTRACT

A model car having a mechanism driven by an electric motor for selectively raising and lowering the front of the car in synchronization with actuation of the hood, and raising and lowering the rear of the car in synchronization with actuation of the trunk lid.

20 Claims, 4 Drawing Sheets

HOOD AND TRUNK LID LIFTING MECHANISM FOR MODEL CAR

FIELD OF THE INVENTION

The present invention relates to model vehicles and more particularly to a model car having a mechanism for selectively raising and lowering the hood and the trunk lid in respect of the body.

BACKGROUND OF THE INVENTION

The prior art is replete with model cars and other similar vehicle replicas having wheels which may be driven, typically by a D.C. electric motor, to propel the vehicle forward or backward. Toy manufacturers constantly seek new ways to add innovative action to such model vehicles to make such vehicles more versatile and entertaining. An increasing demand for more realistic action in model vehicles has led manufacturers to imitate the action and movement of real vehicles. Such innovative action and moving parts in a model vehicle imparts great interest in the attending youth.

An object of the invention is to produce a model car which can be selectively caused to raise or lower the hood or the trunk lid.

Another object of the invention is to produce a model car wherein the hood and the trunk lid of the model car may be selectively raised or lowered in respect of the car body, by the actuation of a reversible direct current electric motor.

SUMMARY OF THE INVENTION

The above, as well and other objects of the invention, may be readily achieved by a model car assembly including:

- a chassis;
- ground engaging means for supporting the chassis;
- a body including at least one of a hood or a trunk lid hingedly connected to the body;
- a first cam member engagable with one of the hood and the trunk lid; and
- a drive motor for actuating the first cam member for raising and lowering the one of the hood and the trunk lid.

BRIEF DESCRIPTION OF THE DRAWINGS

The above, as well as other objects, features, and advantages of the present invention will be understood from the detailed description of the preferred embodiments of the present invention with reference to the accompanying drawings, in which.

DETAILED DESCRIPTION OF THE PREFERRED EMBODIMENT

Figure 1:
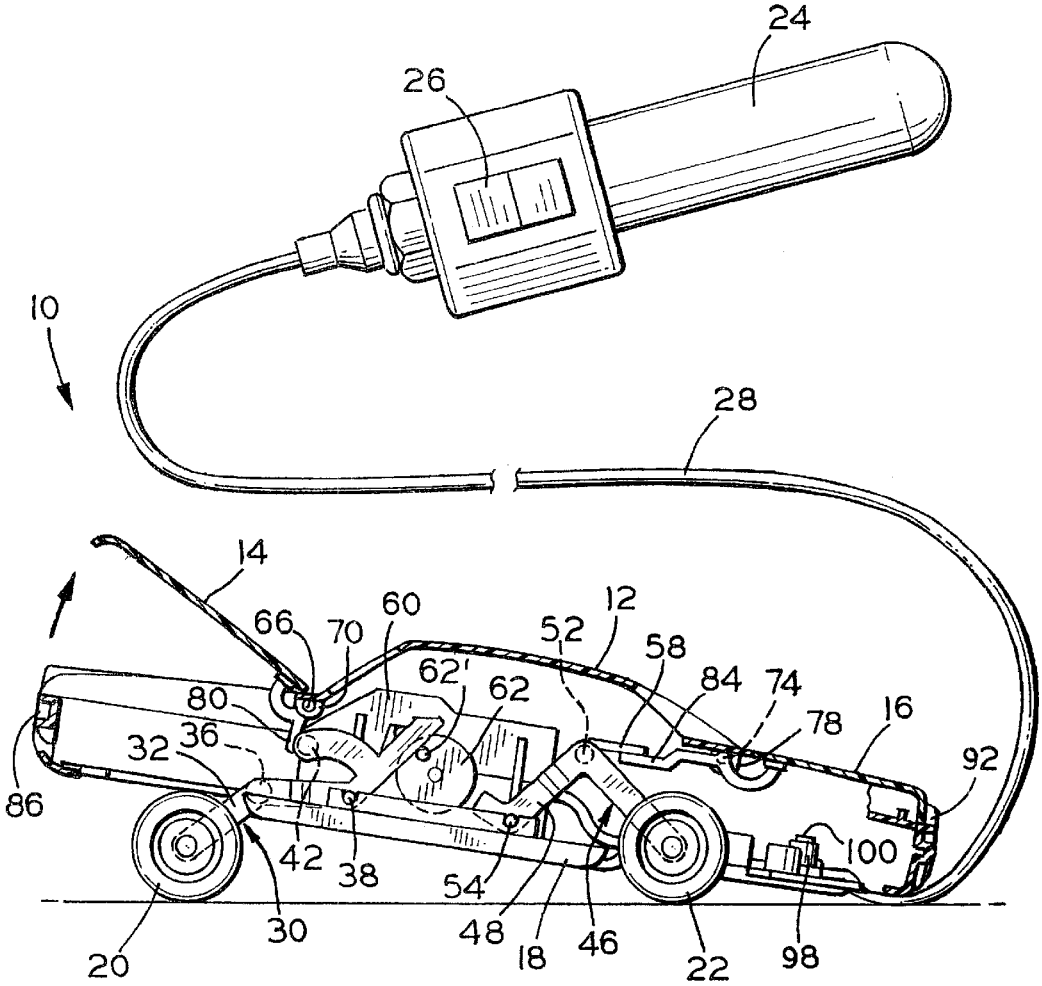
FIG. 1 is a side elevational view with portions cut away and in section to more clearly illustrate the structure of a model car incorporating the features of the invention, and illustrating the front portion of the car and the hood in the elevated position, and the rear portion of the car and the trunk lid in the down or rest position.

Referring to the drawings, there is illustrated a preferred embodiment of the invention in the form of a model car capable of selectively intermittently raising and lowering the hood and the trunk lid in respect of the body. The preferred embodiment is further capable of selectively raising and lowering the front of the car in respect of the associated front wheel assembly, and raising and lowering the rear of the car in respect of the associated rear wheel assembly in respective synchronization with the actuation of the hood and the trunk lid. Additionally, the model car is capable of selectively causing the headlights and the taillights to be lighted.

More specifically, there is shown in the drawings a model car, generally indicated by reference numeral 10, including a body portion 12 having a hood 14 and a trunk lid 16; a chassis 18; ground engaging front wheels 20, 20'; ground engaging rear wheels 22, 22'; and a power source 24, containing suitable batteries and having a rocker switch 26, coupled to a reversible electric motor 25 through a first flexible power cord 28.

The car body 12 typically replicates the sheet metal, glass, and bumpers of a conventional commercial vehicle. The chassis 18 is formed to replicate the vehicle frame, suspension components, and certain other components of the running gear. The car body 12 is adapted to be coupled to the chassis 18 by fastening means such as threaded fasteners, for example. The body portion 12, hood 14, trunk lid 16, and the chassis 18 may typically be formed of a plastic material which may be formed to genuinely represent the commercial vehicle. The plastic components may be glued together and/or assembled by suitable threaded fasteners.

The suspension of the car 10 includes ground engaging front wheels 20, 20', and a front axle arm assembly 30. The front axle arm assembly 30, as clearly illustrated in FIG. 4, includes a pair of spaced apart generally parallel axle arms 32, 34, integrally joined together by a cross arm 36. As further illustrated in FIGS. 2 and 3, pivot pins 38, 40 are disposed intermediate the ends of the axle arms 32, 34, respectively, and are operative to pivotally connect the arms 32, 34 to the respective sides of the chassis 18. Camming surfaces 42, 44 are disposed intermediate the inner ends of the axle arms 32, 34 and the pivot pins 38, 40. The forward outwardly extending terminal portions of the front axle arms 32, 34 are adapted to rotatingly receive the ground engaging front wheels 20, 20', respectively.

Figure 3:
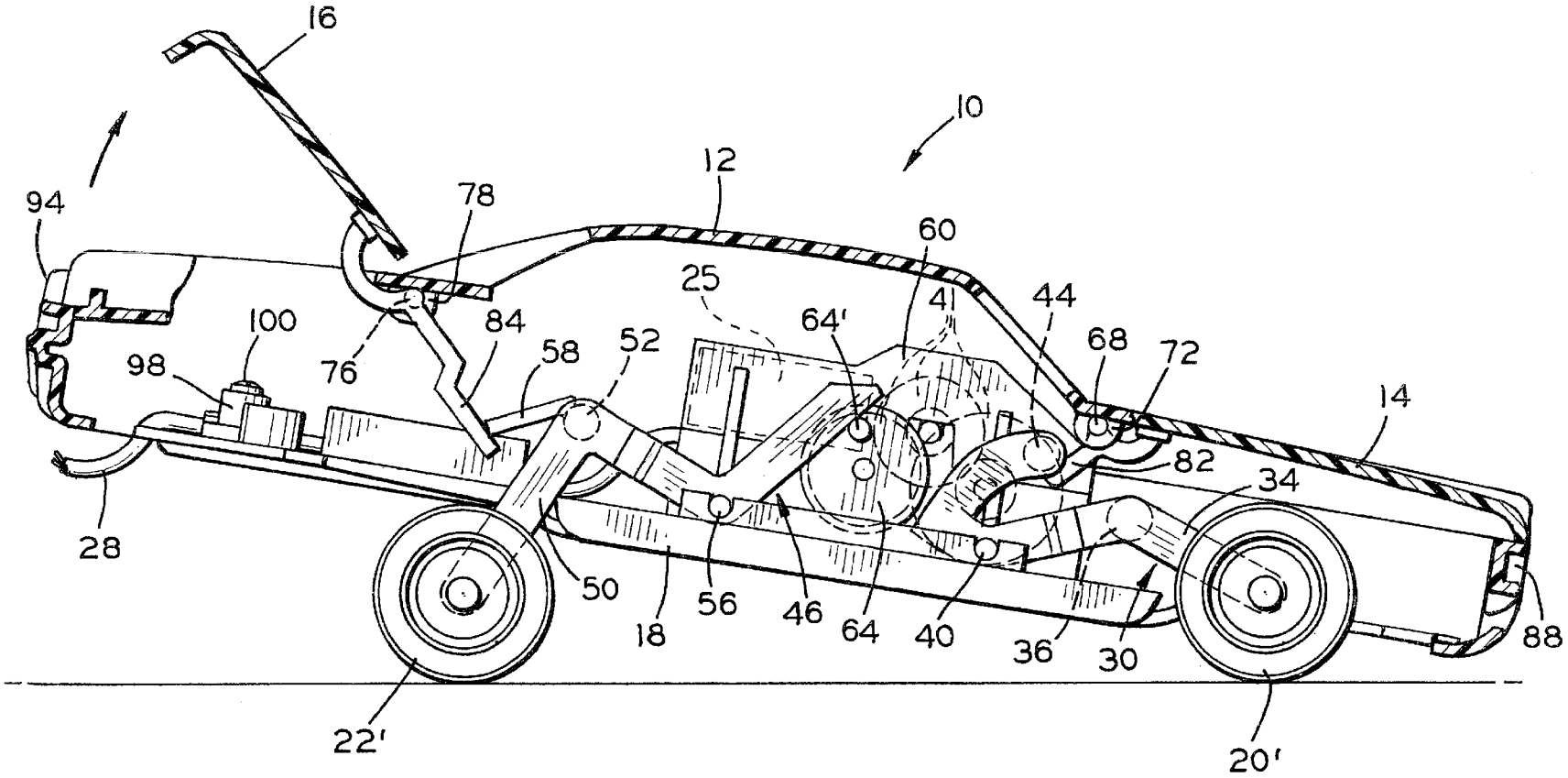
FIG. 3 is an enlarged side elevational view, partially in section, of the opposite side of the model car illustrated in FIG. 2, illustrating the rear portion of the car and the trunk lid in the elevated position, and the front portion of the car and the hood in the down or rest position.
Figure 4:
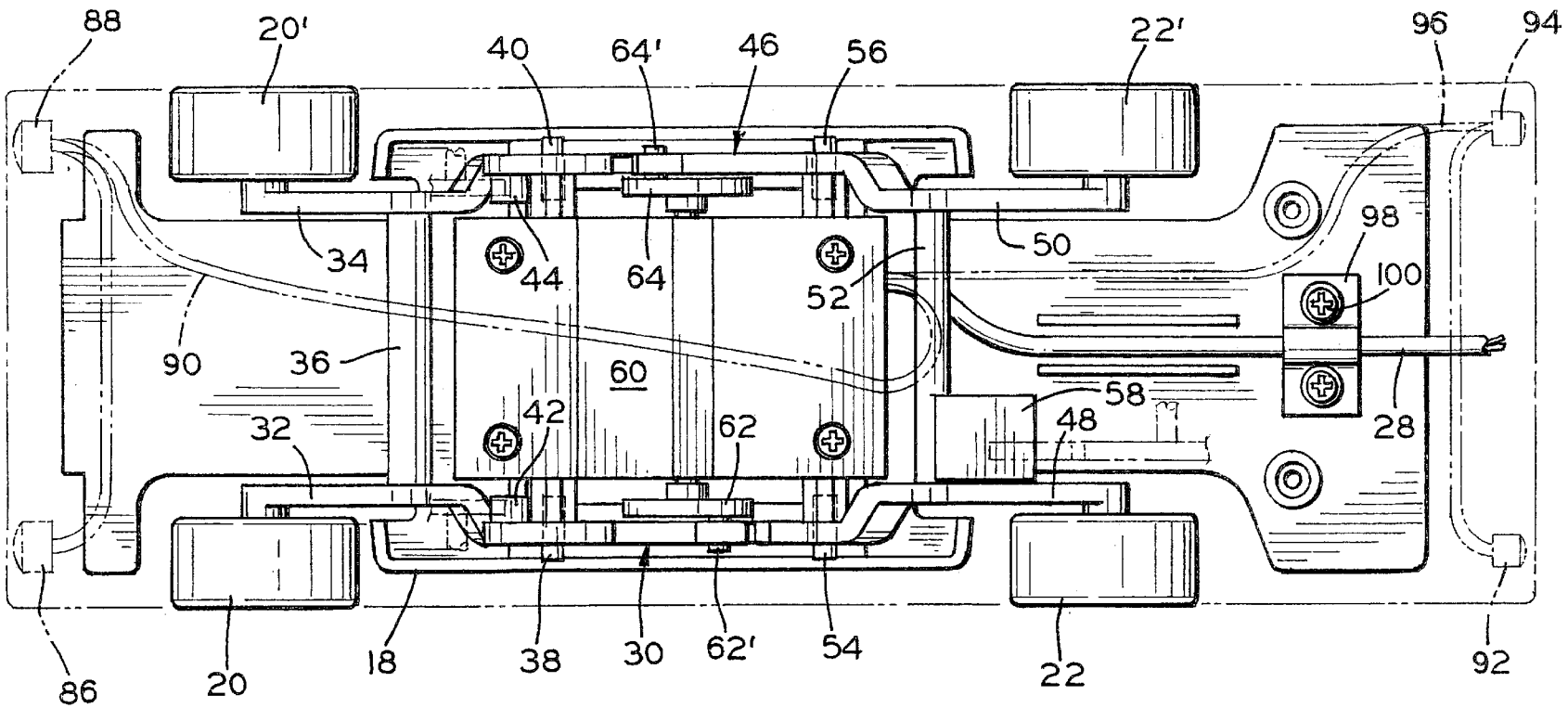
FIG. 4 is a top plan view of the model car illustrated in FIG. 2, with the body portion removed to more clearly show the internal components.

The suspension of the car 10 further includes ground engaging rear wheels 22, 22', and a rear axle arm assembly 46. The rear axle arm assembly 46, as illustrated in FIG. 4, includes a pair of spaced apart generally parallel axle arms 48, 50, integrally joined together by a cross arm 52. As further illustrated in FIGS. 2 and 3, pivot pins 54, 56 are disposed intermediate the ends of the axle arms 48, 50, respectively, and are operative to pivotally connect the arms 48, 50 to the respective sides of the chassis 18. A camming surface 58 is disposed on the cross arm 52 of the rear axle arm assembly 46. The rearward outwardly extending terminal portions of the rear axle arms 48, 50 are adapted to rotatingly receive the ground engaging rear wheels 22, 22', respectively.

The reversible electric motor 25 is suitably mounted within an appropriately formed two-piece enclosure 60 suitably secured to the chassis 18. The motor 25 is provided with an output shaft having an output gear secured thereto. The output gear serves as the power input gear of a gear train 41 capable of selectively delivering power to oppositely disposed first and second cam wheels 62, 64. The first cam wheel 62 is provided with an outwardly projecting cam 62', while the second cam wheel 64 is provided with an outwardly projecting cam 64'. The specific assembly of the electric motor 25 and gear train 41 is of the type illustrated and described in U.S. Pat. No. 6,036,575 to Rehkemper et al.

It will be understood that once the motor 25 and the associated gears of the gear train 41 are disposed in operative position on the base of the enclosure 60, the upper portion of the enclosure 60 is placed over the base and threaded fasteners are typically employed to maintain upper portion in place and simultaneously hold the gear shafts and pivot pins 38, 40, 54, 56 in operative position.

Figure 2:
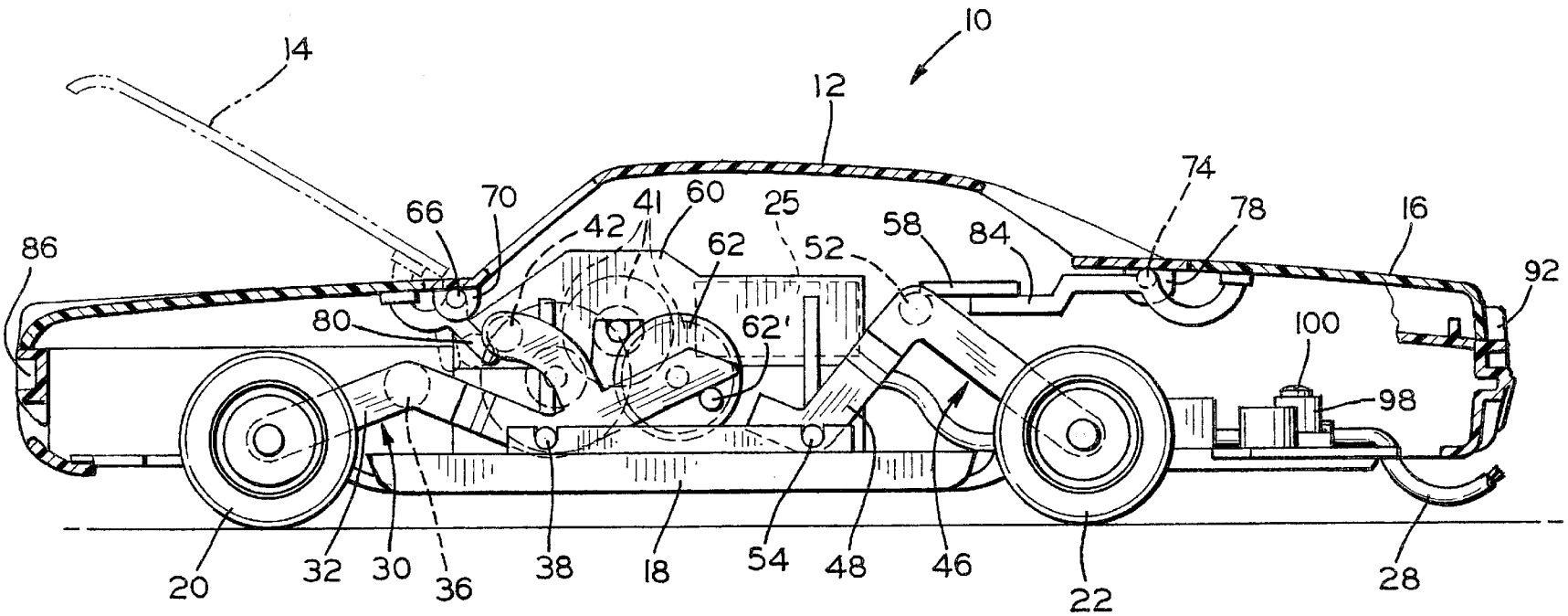
FIG. 2 is an enlarged side elevational view, partially in section, of the model car illustrated in FIG. 1, a phantom line illustrates the hood in the elevated position.

As mentioned before, the body portion 12 includes a hood 14, and a trunk lid 16. Referring now to FIGS. 2, 3, and 4, the inner end of the hood 14 is adapted to be pivotally connected to the body 12 by pivot pins 66, 68. The pivot pins 66, 68 are maintained in the body 12 by brackets 70, 72 secured to the body 12 by fastening means such as threaded fasteners, for example. The inner end of the trunk lid 16 is adapted to be pivotally connected to the body 12 by pivot pins 74, 76. The pivot pins 74, 76 are maintained in the body 12 by a bracket 78 secured to the body 12 by fastening means such as threaded fasteners, for example. In the embodiment shown, the inner end of the hood 14 and the inner end of the trunk lid 16 are pivotally connected to the body 12. However, it is understood that other configurations can be used such as, for example, the outer end of the hood 14, or the outer end of the trunk lid 16 may be pivotally connected to the body 12.

The inner end of the hood 14 includes camming members 80, 82 adapted to slidingly contact the camming surfaces 42, 44 of the front axle arm assembly 30.

The inner end of the trunk lid 16 includes camming member 84 adapted to slidingly contact the camming surface 58 of the rear axle arm assembly 46.

Headlights 86, 88 are disposed in the front portion of the body 12 and adapted to be coupled to the body 12 by fastening means such as threaded fasteners, for example. The headlights 86, 88 are further coupled to the reversible electric motor 25 by a second flexible power cord 90.

Taillights 92, 94 are disposed in the rear portion of the body 12 and adapted to be coupled to the body 12 by fastening means such as threaded fasteners, for example. The taillights 92, 94 are further coupled to the reversible electric motor by a third flexible power cord 96.

The first flexible power cord 28 is caused to extend from the chassis 18 of the car 10 and is maintained rearward of the chassis 18 by a bracket 98 secured to the chassis 18 by threaded fasteners 100.

In operation the first cam wheel 62 is effective for movement of the front axle arm assembly 30, and the second cam wheel 64 is effective for movement of the rear axle arm assembly 46. Specifically, the cams 62', 64' are effective to cause movement of the front axle arm 32 and the rear axle arm 50, respectively.

Motion is transmitted, as described in detail in the aforementioned U.S. Pat. No. 6,036,575 to Rehkemper et al., causing the cam wheel 62 to be driven in an anticlockwise direction. As the cam wheel 62 is caused to rotate, the cam pin 62' urges the front axle arm 32 to pivot about the pivot pin 38, as clearly illustrated in FIG. 1, causing the front portion of the chassis 18 to be moved upwardly. Further, as the front axle arm 32 pivots about the pivot pin 38, the camming surfaces 42, 44 of the front axle arm assembly 30 contact the camming members 80, 82 of the hood 14, urging the hood 14 to pivot about pivot pins 66, 68, and causing the front portion of the hood 14 to be urged upwardly. Additionally, as the cam wheel 62 is caused to rotate, an electric current generated by the reversible electric motor causes the headlights 86, 88 to be lighted.

When the drive motor 25 is caused to rotate in an opposite or clockwise direction by proper manipulation of the rocker switch 26, the cam wheel 64 is caused to rotate in a clockwise direction. Such rotation of the cam wheel 64 and the associated cam 64' urges the rear axle arm 50 to pivot about a pivot pin 56, causing the rear portion of the chassis 18 to be urged upwardly. Further, as the rear axle arm 50 pivots about the pivot pin 56, the camming surface 58 of the rear axle arm assembly 46 contacts the camming member 84 of the trunk lid 16, urging the trunk lid 16 to pivot about pivot pins 74, 76, and causing the rear portion of the trunk lid 16 to be urged upwardly. Additionally, as the cam wheel 64 is caused to rotate, an electric current generated by the reversible electric motor causes the taillights 92, 94 to be lighted.

In each instance, it will be understood that as soon as the cam members 62', 64' are driven to their respective apogees, the cam members 62', 64' commence to travel downwardly allowing the weight of the front or rear of the model car 10 to return the car to a position of rest at the ground level.

While the preferred embodiment of the invention is directed to a vehicle wherein the hood and the trunk lid may be activated, it will be understood that successful results may be achieved by employing a mechanism for operating only the hood or only the trunk lid.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A model vehicle assembly including:

a chassis;

ground engaging means for supporting said chassis;

a body including at least one of a hood and a trunk lid hingedly connected to said body;

a first cam member engageable with the one of the hood and the trunk lid; and a drive motor for actuating said first cam member for raising and lowering the one of the hood and the trunk lid.

2. The model vehicle according to claim 1, including a first lifting arm coupling said first cam member to the one of the hood and the trunk lid.

3. The model vehicle according to claim 2, wherein said ground engaging means includes a first set of ground engaging wheels and a second set of ground engaging wheels.

4. The model vehicle according to claim 3 wherein said first lifting arm includes an outer end and an inner end, said first lifting arm rotatably receiving said first set of ground engaging wheels intermediate the outer end and the inner end of said arm.

5. The model vehicle according to claim 4 wherein said first lifting arm includes at least one camming surface.

6. The model vehicle according to claim 5, wherein the one of the hood and the trunk lid includes a camming member adapted to contact the camming surface of said first lifting arm.

7. The model vehicle according to claim 6, wherein said first lifting arm includes a first pivotal mounting intermediate the outer and inner ends thereof for pivotally mounting said first lifting arm to said chassis.

8. The model vehicle according to claim 4, wherein said first lifting arm includes at least one camming surface intermediate the outer end and the inner end of said arm.

9. The model vehicle according to claim 3, further comprising a second cam member engageable with the other one of the hood and the trunk lid.

10. The model vehicle according to claim 9, including a second lifting arm coupling said second cam member to the other one of the hood and the trunk lid.

11. The model vehicle according to claim 10 wherein said second lifting arm includes an outer and an inner end, said second lifting arm rotatably receiving said second set of ground engaging wheels intermediate the outer end and the inner end of said arm.

12. The model vehicle according to claim 11 wherein said second lifting arm includes at least one camming surface.

13. The model vehicle according to claim 12, wherein the other one of the hood and the trunk lid includes a camming member adapted to contact the camming surface of said second lifting arm.

14. The model vehicle according to claim 13, wherein said second lifting arm includes a second pivotal mounting intermediate the outer and inner ends thereof for pivotally mounting said second lifting arm to said chassis.

15. The model vehicle according to claim 14, wherein said second lifting arm rotatably receives said second set of ground engaging wheels at the outer end of said arm.

16. The model vehicle according to claim 11, wherein said second lifting arm includes at least one camming surface intermediate the outer end and the inner end of said arm.

17. The model vehicle according to claim 9, including a gear train for coupling said drive motor to said first cam member and said second cam member.

18. The model vehicle according to claim 3, wherein said first lifting arm rotatably receives said first set of ground engaging wheels at the outer end of said arm.

19. The model vehicle according to claim 1, wherein said drive motor is a reversible drive motor.

20. A model vehicle assembly including:

a chassis;

a first set of ground engaging wheels;

a second set of ground engaging wheels;

a body disposed on said chassis;

at least one first lifting arm having an outer and an inner end, said arm adapted for rotatably receiving said first set of ground engaging wheels intermediate the outer end and the inner end thereof, said arm including a camming surface;

a first pivotal mounting intermediate the outer end and the inner end of said first lifting arm for pivotally mounting said first lifting arm to said chassis;

a hood including a first hinged mounting disposed thereon for coupling said hood to said body, and a camming member adapted to contact the camming surface of said first lifting arm;

at least one second lifting arm having an outer and an inner end, said arm adapted for rotatably receiving said second set of ground engaging wheels intermediate the outer end and the inner end thereof, said arm including a camming surface;

a second pivotal mounting intermediate the outer end and the inner end of said second lifting arm for pivotally mounting said second lifting arm to said chassis;

a trunk lid including a second hinged mounting disposed thereon for coupling said trunk lid to said body, and a camming member adapted to contact the camming surface of said second lifting arm;

a reversible drive motor;

a first cam member engaging said first lifting arm between the inner end thereof and said first pivotal mounting;

a second cam member engaging said second lifting arm between the inner end thereof and said second pivotal mounting; and a gear train for coupling said drive motor to said first cam member and said second cam member, whereby energization of said motor in a first direction drives said first cam member and energization of said motor in a second direction drives said second cam member.

* * * * *